US005901374A

United States Patent [19]

Foster

[11] Patent Number: 5,901,374

[45] Date of Patent: May 11, 1999

[54] FLEXIBLE KNEE WADER

[75] Inventor: Ronald W. Foster, Batavia, Ill.

[73] Assignee: Hodgman, Inc., Montgomery, Ill.

[21] Appl. No.: 09/044,138

[22] Filed: Mar. 19, 1998

[51] Int. Cl.[6] ..... A41B 11/00

[52] U.S. Cl. ..... 2/82; 2/242; 2/79; 2/227

[58] Field of Search ..... 2/2.15, 78.1, 78.3, 2/79, 81, 82, 83, 404, 227, 242

[56] References Cited

U.S. PATENT DOCUMENTS

| | | | |
|---|---|---|---|
| Re. 34,662 | 7/1994 | Keller | 2/82 |
| 899,500 | 9/1908 | Bartram | 2/227 |
| 1,099,875 | 6/1914 | Fuiks | 2/227 |
| 1,488,536 | 4/1924 | Fry | 2/227 |
| 2,569,451 | 10/1951 | Browne . | |
| 2,679,647 | 6/1954 | Gossner . | |
| 2,749,551 | 6/1956 | Garbellano . | |
| 3,268,914 | 8/1966 | Barber | 2/82 |
| 3,329,966 | 7/1967 | Slavick . | |
| 4,117,552 | 10/1978 | Simpson . | |
| 4,509,213 | 4/1985 | Harvey . | |
| 4,912,860 | 4/1990 | Keller | 2/227 X |
| 5,031,242 | 7/1991 | Aldridge et al. | 2/81 |
| 5,081,718 | 1/1992 | Carman et al. | 2/227 |
| 5,219,367 | 6/1993 | Fields | 2/227 |
| 5,247,708 | 9/1993 | Freese, Jr. . | |
| 5,611,082 | 3/1997 | Bull | 2/79 |
| 5,652,966 | 8/1997 | Reinert, Sr. . | |
| 5,711,031 | 1/1998 | Clement | 2/82 |

*Primary Examiner*—Gloria M. Hale

*Attorney, Agent, or Firm*—Jacobson, Price, Holman & Stern, PLLC

[57] ABSTRACT

A garment which eliminates the need for additional inseam material by using a panel of stretch material such as spandex, rubber or rubber compounds, or synthetic rubber, such as neoprene or neoprene sponge in the knee area where bending takes place to allow the knee to bend freely. The panel of stretch material used at knee portion of the garment fills an opening formed in the rigid woven fabric material making up the rest of the garment. The panel of stretch material is sewn in place covered with a waterproof tape which overlaps the edges of the stretch material panel and the woven fabric material. Stitching secures the stretch material in place, which overlaps the woven fabric material. The stretch material panel includes waterproof properties as does the remainder of the woven fabric material garment.

20 Claims, 1 Drawing Sheet

FLEXIBLE KNEE WADER

FIELD OF THE INVENTION

The present invention provides enhanced freedom of motion when wearing garments constructed of non-stretchable material.

BACKGROUND OF THE INVENTION

Most waders are constructed with a rigid, non-stretch woven fabric, such as nylon (usually taffeta), cotton (sheeting), or polyester. The fabric is then coated with a waterproof material such as polyvinylchloride, polyurethane, or material or synthetic rubber. The fabric is the supporting material for the waterproof coating. The waterproof coating can be used either on the inside or the outside of the garment. Knitted fabrics are not widely used in the construction of waders in that waterproof coatings do not adhere well to knitted fabrics.

In waders, the legs of the wader are attached to a bootie. Due to the attachment of the leg to the bootie and the non-stretch properties of the woven fabric support material, the woven fabric support material does not allow the leg to move upwards when the knee is bent during walking motion. Accordingly, additional inseam material, greater than the user's actual inseam measurement, is required. Otherwise the user could bend their knee.

Therefore, it is common practice in the construction of a pair of waders made from a rigid, non-stretch woven fabric to add several inches of material, typically three to seven inches of inseam material to accommodate the walking motion. This adds additional expense to the garment and to do not so would make the product unusable.

In U.S. Pat. No. 4,117,552 to Simpson, the leg portions of a protective clothing garment include excess fabric over the outside knee and elbow joints by means of additional material tucks to aid in mobility of the garment. The excess fabric coincides with the joint region for all joint positions in a particular size.

In U.S. Pat. No. 4,509,213 to Harvey, a plurality of accordeon pleats extend transversely across a front portion of each legging of a rain cover for motorcyclist's legs in the region of the knee. When the knee is flexed, the accordeon pleats open and no upward pull is exerted on the remainder of the garment. The accordeon pleats are formed by an extra length of material at the knee level of the front panel.

SUMMARY OF THE INVENTION

It is an object of the present invention to eliminate the need for some or all additional inseam material by using a panel of stretch material such as spandex, rubber or rubber compounds, or synthetic rubber, such as neoprene or neoprene sponge in the knee area where bending takes place to allow the knee to bend freely.

The dimensions of this stretch material may vary from as little as six inches by six inches to twelve inches by twelve inches or more, which would cost considerably less than making the entire product out of a flexible material and which would not be as strong as using a rigid woven fabric material for a majority of the garment. The flexible material is more or less centered on the knee or the other joint area.

The panel of stretch material used at the knee portion of the garment fills an opening formed in the rigid woven fabric material making up the rest of the garment. The panel of stretch material is sewn in place and covered with a waterproof tape which overlaps the edges of the stretch material panel and the woven fabric material. Stitching secures the panel material in place, overlapping the woven fabric material. The stretch material panel includes waterproof properties as does the remainder of the woven fabric material garment.

Alternatively, the stretch material panel is glued in an opening of the woven fabric material. Other means of securing the stretch material panel in place are also acceptable. However, the stretch material panel needs to be allowed to stretch in a centrolled area in a central manner to allow bending of the joints of the wearer of the garment.

Various degrees of stretching of the stretch material panel are acceptable. For example, if the thickness of the stretch material panel is one millimeter or less, the material will preferably be able to stretch to 200% of its original dimensions. For a panel of 1 to 2 millimeters in thickness, a stretch factor of 150 to 160% is preferred. For a thickness of 2 to 3 millimeters, a stretch factor of 130 to 150% is preferred. For a thickness of 3 to 4 millimeters, a stretch factor of 125% is preferred whereas for a maximum thickness of 4 to 5 millimeters, a stretch factor of 120% is preferred.

The great amount of stretch of the stretch material panel as compared to the essentially non-stretch woven fabric material of the remainder of the garment provides for stretching of the panel when the leg of the wearer of the garment is lifted and/or bent. An angle of bend of the knee of 45° to 90° is easily accommodated. This facilitates walking, climbing and stepping over objects which could not previously be accomplished by a form fitting garment made of woven fabric material which closely fit the wearer of the garment.

Accordingly, it is another object of the present invention to provide a garment which closely surrounds the legs of a wearer and includes panels of stretch material at the knees of the garment so as to allow bending of the legs.

It is still another object of the present invention to provide a form fitting garment made of essentially no stretch woven fabric material which includes panels of stretch material positioned at the bending joints for the wearer of the garment to allow bending of the joints by the stretch of the stretch material panels without the need for increasing the overall length of the garment.

It is still yet another object of the present invention to provide a form fitting garment made of essentially non-stretch woven fabric material and including panels of stretch material secured in openings of the rigid woven material for placement of the panels over bendable joints of the wearer so as to accommodate bending of the joints of the wearer without increasing the overall dimensions of the garment as previously required to accommodate bending of the joints of the wearer.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
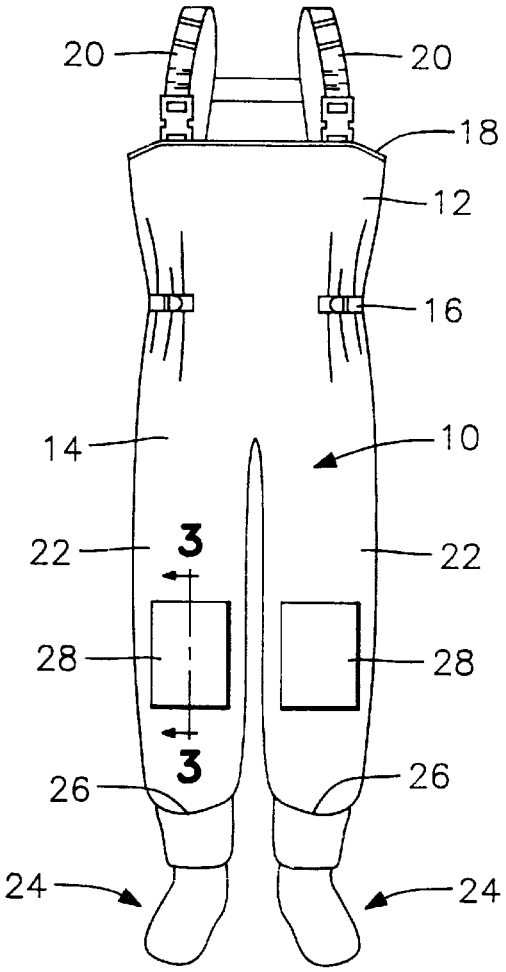
FIG. 1 illustrates a chest high wader representative of a garment incorporating the principles of the present invention, made of rigid woven fabric material and including panels of stretch material positioned over joints of the wearer of the garment so as to allow bending of the joints in a form fitting garment.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
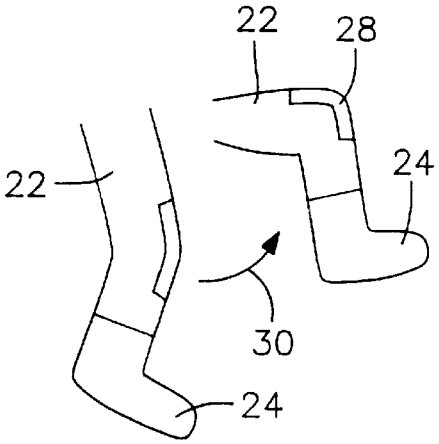
FIG. 2 schematically illustrates the bending of a joint in a garment incorporating the principles of the present invention.

With reference to the drawings, in general, and to FIGS. 1 and 2, in particular, a garment embodying the teachings of the subject invention is generally designated as 10. With reference to its orientation in FIG. 1, the garment 10 is a wader, for illustrative purposes, having an upper torso portion 12 and a lower torso portion 14. Waist tightening straps 16 are sometimes located in between the upper and lower torso portions 12 and 14. Extending from the upper edge 18 of the upper torso portion are shoulder straps 20.

Lower torso portion 14 includes two leg portions 22 which are secured to and terminate in booties 24. The lower ends 26 of leg portions 22 are secured to the tops of the booties 24. Accordingly, with bottom edges of the ends 26 of the leg portions of the garment being secured to booties 24 and the shoulder straps 20 extending over the shoulders of a wearer of a garment 10, the whole garment is worn in a tensioned condition between the feet and the shoulders of the wearer. To enable the bending of the knees of the wearer, prior garments have not been able to be worn in a tensioned condition due to an additional length of material in the inseam areas to accommodate the bending of the knees.

However, according to the present invention, in a garment 10 made of essentially non-stretch, rigid woven fabric material, at the areas of the garment to be positioned over the joints of the wearer, panels 28 are formed in the garment, as in the knee area of the garment 10 shown in FIG. 1. The garment is otherwise in a tensioned condition between the feet and shoulders of the wearer.

Panels 28 are made of stretch material which allow bending of the knees of the wearer when a leg 22 is bent, as shown in FIG. 2, from a substantially straight orientation to a position, as shown by arrow 30, where the leg 22 is bent to approximately a 90 degree angle. The minimum amount of stretch of 120% for the panel 28 allows the bending of the leg of the wearer even though the remainder of the garment 10 is in a tensioned condition between the boots 24 and the shoulder straps 20 of the garment.

Figure 3:
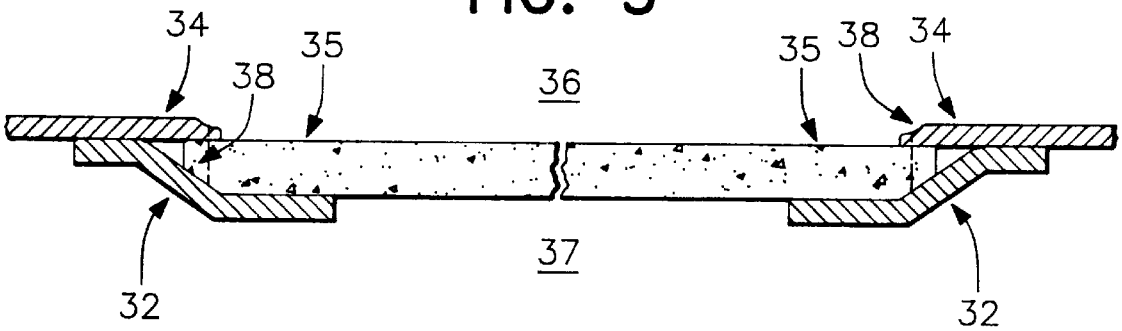
FIG. 3 is a cross-sectional view taken along line 3—3 of FIG. 1 which illustrates the securing of a panel of stretch material in an opening of a rigid woven fabric material.

Panel 28 is secured in the garment 10 by allowing an opening in the leg portions 22 of the garment and securing the stretch material panel 28 in the openings of the leg portions. As shown in FIG. 3, in a preferred embodiment, the stretch material 35 is stitched to the rigid fabric material 34 from the outside 36 of the garment to the inside 37 of the garment between the leg portion 22 and the bootie portion 26 and then a stretch waterproof tape 32 is applied on the inside of the garment 37 over the seam 38.

Alternatively, the panel 28 of stretch material may be glued in the opening of the leg portion or other means may be used to secure the panel 28 of stretch material in place in the openings formed in the leg portions of the garment 10. The panels 28 of stretch material are positioned over the knee of the wearer of the garment. Similarly, a panel of stretch material may be positioned over an elbow of a wearer in a garment covering the arms of a wearer where the garment is primarily made of a non-stretch material.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A garment comprising:

leg portions made of a woven fabric, an opening located in each of said leg portions in a knee area of said leg portions, a panel secured in each of said openings, said panel being a stretchable material for providing stretching of the knee area of the garment during bending of the legs of the wearer of the garment, and a waterproof tape surrounding each said opening and overlapping onto and being secured to said leg portion and said panel.

2. A garment as claimed in claim 1, wherein said woven fabric is essentially a non-stretch material.

3. A garment as claimed in claim 1, wherein said leg portions are part of a garment including shoulder straps at one end and boots at an opposite end to maintain the garment in a tensioned condition between the shoulders and the feet of a wearer of the garment.

4. A garment as claimed in claim 1, wherein the panels are sewn in said openings of said leg portions.

5. A garment as claimed in claim 2, wherein said leg portions and said panels are waterproof.

6. A garment as claimed in claim 5, wherein said panels have a stretch factor of at least 120%.

7. A garment comprising:

an upper torso portion, a lower torso portion formed integral with said upper torso portion, two leg portions formed in said lower torso portion, booties secured to said two leg portions, an opening in a knee area of each of said two leg portions, a panel secured in each said opening of said two leg portions, said panels being a stretchable material for providing stretching of the knee areas of the garment during bending of the legs of the wearer of the garment, and a waterproof tape surrounding each said opening and overlapping onto and being secured to said leg portion and said panel.

8. A garment as claimed in claim 7, wherein said upper torso and said lower torso are made of a non-stretch material.

9. A garment as claimed in claim 8, wherein the non-stretch material is woven fabric.

10. A garment as claimed in claim 9, wherein the woven fabric is waterproof.

11. A garment as claimed in claim 7, wherein said panels have a stretch factor of at least 120%.

12. A garment as claimed in claim 7, wherein said upper torso portion includes shoulder straps to maintain the garment in a tensioned condition between the shoulders and the feet of the wearer of the garment.

13. A garment as claimed in claim 7, wherein the panels are sewn in the openings of two leg portions.

14. A garment as claimed in claim 13, wherein said panels are waterproof.

15. A garment as claimed in claim 7, wherein the garment is a wader.

16. A garment comprising:

portions of the garment positionable over joints of a wearer of the garment, an opening in the garment at the portions of the garment positionable over the joints of the wearer of the garment, a panel secured in said opening in the garment at the portions of the garment positionable over the joints of the wearer of the garment, said panel being a stretchable material for providing stretching of the portions of the garment during bending of the joints of the wearer of the garment, and a waterproof tape surrounding each said opening and overlapping onto and being secured to the garment and the panel.

17. A garment as claimed in claim 16, wherein the garment is a wader.

18. A garment as claimed in claim 16, wherein the garment and the panel are waterproof.

19. A garment as claimed in claim 18, wherein the portions of the garment are made of a woven fabric material.

20. A garment as claimed in claim 16, wherein the panel is sewn in the opening.

* * * * *